US011739572B2

(12) United States Patent
Kuniyil et al.

(10) Patent No.: US 11,739,572 B2
(45) Date of Patent: Aug. 29, 2023

(54) DOOR HANDLE ASSEMBLY

(71) Applicant: Illinois Tool Works Inc., Glenview, IL (US)

(72) Inventors: Nidhin Kuniyil, Maharashtra (IN); Ravindra Desai, Maharashtra (IN); Virupaxi P., Maharashtra (IN)

(73) Assignee: Illinois Tool Works Inc., Glenview, IL (US)

( * ) Notice: Subject to any disclaimer, the term of this patent is extended or adjusted under 35 U.S.C. 154(b) by 918 days.

(21) Appl. No.: 16/656,093

(22) Filed: Oct. 17, 2019

(65) Prior Publication Data

US 2020/0131814 A1 Apr. 30, 2020

(30) Foreign Application Priority Data

Oct. 25, 2018 (IN) ..... 201821040342

(51) Int. Cl.
*E05B 85/14* (2014.01)
*E05B 85/10* (2014.01)

(52) U.S. Cl.
CPC ..... *E05B 85/103* (2013.01); *E05B 85/14* (2013.01)

(58) Field of Classification Search
CPC ..... E05B 85/103; E05B 85/107; E05B 5/00; E05B 5/003; Y10S 292/31; Y10T 292/57
See application file for complete search history.

(56) References Cited

U.S. PATENT DOCUMENTS

| | | | | |
|---|---|---|---|---|
| 4,510,779 | A | 4/1985 | Ahad | |
| 5,123,687 | A * | 6/1992 | Pfeiffer | E05B 1/0092 292/DIG. 31 |
| 8,701,353 | B2 * | 4/2014 | Patel | E05B 85/103 292/201 |
| 9,062,478 | B2 * | 6/2015 | Bingle | E05B 85/107 |
| 9,322,191 | B2 * | 4/2016 | Müller | E05B 85/107 |
| 9,605,452 | B2 * | 3/2017 | Yoshino | E05B 85/107 |
| 10,731,387 | B2 * | 8/2020 | Sobecki | E05B 81/14 |
| 10,794,096 | B2 * | 10/2020 | Hamacher | E05B 5/006 |
| 2011/0148575 | A1 | 6/2011 | Sobecki et al. | |
| 2014/0265372 | A1 * | 9/2014 | Smart | E05B 5/003 292/336.3 |

FOREIGN PATENT DOCUMENTS

| | | | | |
|---|---|---|---|---|
| CN | 105917063 | A | 8/2016 | |
| CN | 108222715 | A | 6/2018 | |
| CN | 108474221 | A | 8/2018 | |
| DE | 102011001001 | A1 * | 6/2012 | E05B 85/103 |
| EP | 3078793 | A1 * | 10/2016 | E05B 13/002 |
| FR | 3071861 | A1 * | 4/2019 | |

* cited by examiner

*Primary Examiner* — Carlos Lugo
(74) *Attorney, Agent, or Firm* — Quarles & Brady LLP

(57) ABSTRACT

A door handle assembly includes a frame, a mechanical deployment unit, and a handle. The frame is to be mounted to a door. The frame having a housing portion and an exterior surface having a cavity. The mechanical deployment unit is disposed in the housing portion. The handle is disposed in the cavity, pivoted to the frame and operably coupled to the mechanical deployment unit. The handle is flush with the exterior surface and locked with the mechanical deployment unit in an undeployed position. Upon a first actuation, the handle unlocks from the undeployed position to protrude from the cavity in a deployed position and moves back to the undeployed position upon a second actuation.

18 Claims, 7 Drawing Sheets

DOOR HANDLE ASSEMBLY

CROSS REFERENCE TO RELATED APPLICATIONS

This application is based on, claims priority to, and incorporates herein by reference in its entirety, India Application No. 201821040342, filed on Oct. 25, 2018, and entitled "DOOR HANDLE ASSEMBLY."

TECHNICAL FIELD

The present subject matter relates, in general, to a handle assembly and, in particular but not exclusively, to a door handle assembly.

BACKGROUND

For aesthetic appeal of exteriors and interiors, nowadays, vehicles are provided with flush door handles. Such a door handle is retractably mounted to a vehicle door such that the handle is flush with a side wall of the vehicle door, for example, facing a passenger compartment of the vehicle, when not in use or undeployed. The flush door handles may be movable between the undeployed or flush position and a deployed position. In the deployed position, the handle protrudes from the side wall for being pulled by a user to open the vehicle door. The flush door handle may be coupled to a latch mechanism of the vehicle door, such that when the user pulls the handle from the deployed position, the handle may unlatch the vehicle door.

BRIEF DESCRIPTION OF DRAWINGS

The detailed description is provided with reference to the accompanying figures. It should be noted that the description and the figures are merely examples of the present subject matter and are not meant to represent the subject matter itself.

Figure 1:
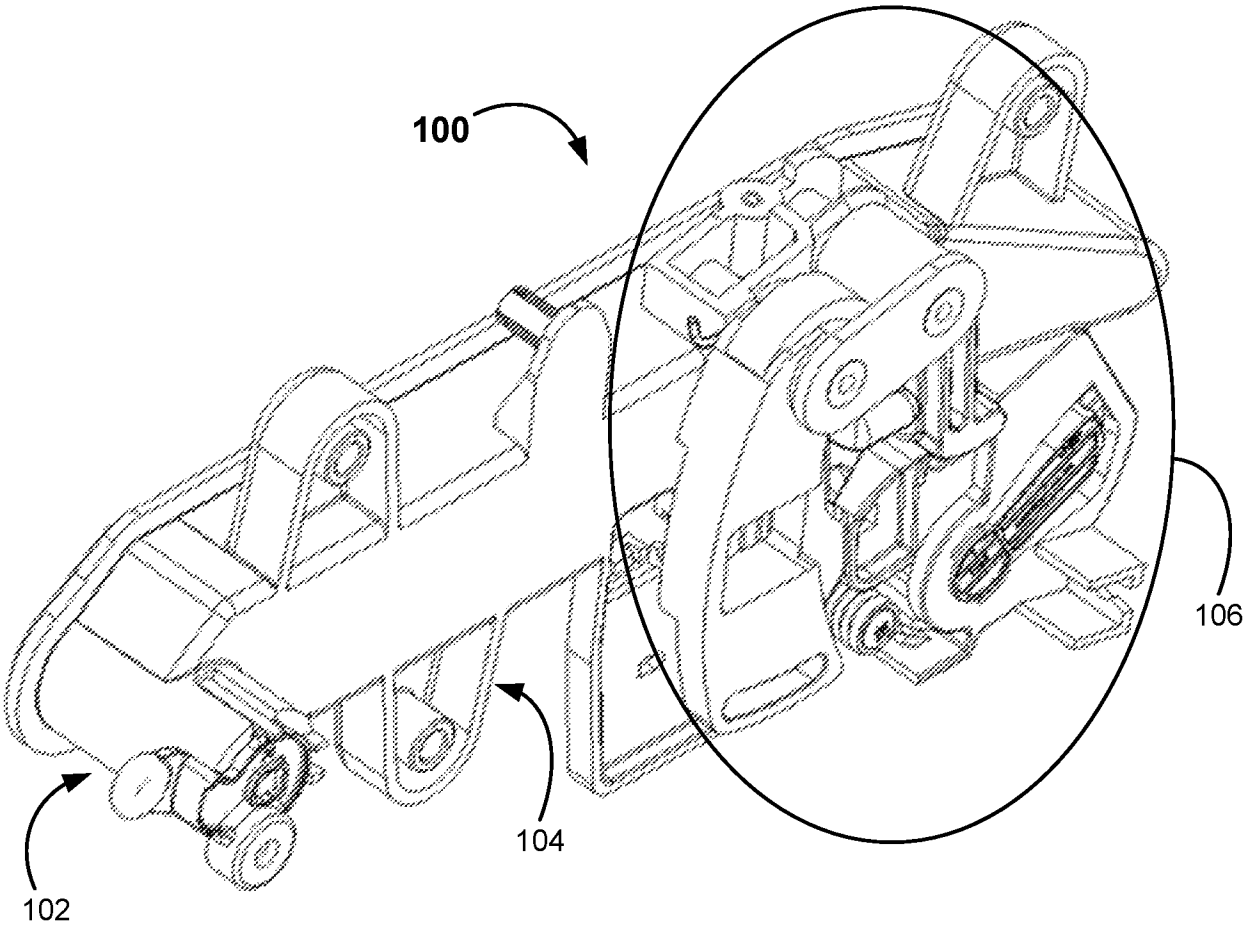
FIG. 1 illustrates a perspective view of a door handle assembly, according to an example implementation of the present subject matter.

Throughout the drawings, identical reference numbers designate similar elements, but may not designate identical elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Conventional flush door handles that are deployed in vehicle doors employ electric motors or electrical switches for moving a handle from a flush position, in which the handle is in-line with an exterior surface of a vehicle door, to a deployed position and vice-versa. Further, the handle may be coupled to a latch mechanism that facilitates in unlocking a vehicle door and for opening the vehicle door. The handle is moved to the deployed position, by using an electrical motor, before being manually pulled to open the vehicle door. However, the electric motor as deployed in the vehicle door may be cost inefficient, in terms of the cost of the component as well as the cost of sub-components used for its operations, such as a controller and a protection aid. At the same time, use of an electric motor for movement of the handle may involve a complex assembly of various parts which can acquire space and can further add to the cost. In addition, use of such a complex assembly is cumbersome during the manufacturing, it may also be prone to high degree of wear and tear, thereby, requiring frequent servicing, repair, or replacement of the parts. Thus, electric motor operated flush handles may turn out to be costly as components, as well as in terms of ownership from a user's point of view. In addition, upon failure of the electrical motor, the handle may not be movable to the deployed position and, thus, a user may face difficulties in opening the vehicle door. Moreover, housing the electric motor with a lock assembly in the door, of the vehicle, may add on to a weight of the door, and accordingly, to that of the vehicle.

Examples of the present subject matter relating to a door handle assembly are described herein. The door handle assembly includes a handle movable between the flush or undeployed position to the deployed position by means of mechanical linkages and without utilizing an electric motor. For example, to move the handle from the flush position to the deployed position, the handle is mechanically actuated, such as by pressing the handle or by giving a push to the handle. Thereafter, to move the handle back in the flush position, another actuation, such as a manual pull may be provided. The mechanical actuation of the handle provides a cost-effective and simplified door handle assembly. Further, various mechanical couplings reduce overall weight of the door implementing the door handle assembly of the present subject matter.

The present subject matter describes a door handle assembly having a frame for mounting to the door. The frame may include a housing portion and an exterior surface having a cavity. Further, the door handle assembly includes a handle pivoted to the frame and disposed in the cavity. In an aspect, the handle is movable between the undeployed position and the deployed position, upon being actuated. For example, in the undeployed position, the handle is flush with the exterior surface of the frame. In the deployed position, the handle protrudes from the exterior surface of the frame.

Further, the door handle assembly includes a mechanical deployment unit operably coupled to the handle. In an implementation, the mechanical deployment unit includes a leading actuation component operably coupled to the handle. In the undeployed position, the leading actuation component is lockable with respect to the frame to lock the handle in the undeployed position. The mechanical deployment unit also includes a trailing actuation component operably coupled to the handle and the leading actuation component.

When a first actuation, such as a manual push, is provided to the handle, the actuator member may cause the leading actuation component to rotate and release the handle from a locked state. As the handle is released from the locked state, as soon as a first actuation force is removed, the handle moves from the undeployed position to the deployed position. When a second actuation is provided to the actuator member of the handle, the trailing actuation component may cooperate with the leading actuation component to bring the leading actuation component into the locked state with respect to the frame. The second actuation may, therefore, bring the handle back in the undeployed position.

Accordingly, the actuator member of the handle and the mechanical deployment unit as described in the present subject matter provide a cost-effective and simple door handle assembly.

The present subject matter is further described with reference to the accompanying figures. Wherever possible, the same reference numerals are used in the figures and the following description to refer to the same or similar parts. It should be noted that the description and figures merely illustrate principles of the present subject matter. It is thus understood that various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates a perspective view of a door handle assembly 100, according to an example implementation of the present subject matter. The door handle assembly 100 includes a frame 102 to be mounted to a door (not shown), such as of a vehicle. In an example, the frame 102 includes a housing portion 104 and an exterior surface having a cavity (not shown). Further, the door handle assembly 100 includes a mechanical deployment unit 106 disposed within the housing portion 104 of the frame 102.

In addition, the door handle assembly 100 includes a handle (not shown) disposed in the cavity of the frame 102. The handle may include an actuator member (not shown). The handle may be pivoted to the frame 102. In an example, the handle is shaped to fit in the cavity of the frame such that the handle is flush with the exterior surface of the frame 102. Further, the handle may be operably coupled to the mechanical deployment unit 106 and a latch mechanism (not shown) of the door. In an example, the handle may be coupled to the mechanical deployment unit 106 through the actuator member of the handle. Further, the handle may be movable between a flush or an undeployed position to a deployed position with respect to the frame 102. For example, in the undeployed position, the handle may be flush with the exterior surface of the frame 102 and in the deployed position, the handle may protrude away from the cavity.

To move the handle from the undeployed position to the deployed position, the handle is a first actuation. For example, when a user may push or press a portion of the handle, the handle may move from the flush position to the deployed position. This may cause a portion of the handle to protrude away from the cavity of the exterior surface of the frame 102 and the handle may be considered in the deployed position. The user may then pull the protruded portion of the handle further away from the cavity to unlatch the latch mechanism. The pulling action of the user thereby results in opening the vehicle door. The action of pulling the protruded portion of the handle further away from the cavity constitutes a second actuation and also unlatches the vehicle door. In response to the second actuation, the mechanical deployment unit 106 causes the handle to move back to the flush position. In an example, the second actuation is provided in a direction opposite to the first actuation. Details pertaining to the mechanical deployment unit 102 are provided in conjunction with FIGS. 2A & 2B.

The door handle assembly of the present subject matter therefore provides a relatively simple mechanical action for moving the handle between the undeployed and the deployed positions. Various mechanical linkages of the mechanical deployment unit 106, as will be described later, provides a light weight door handle assembly 100 which is easy to assemble. In addition, the present subject matter provides a cost-effective technique to move the handle between the flush position and the deployed position.

It is to be noted that although the foregoing description is provided with respect to a door, such as a vehicle door, the door handle assembly of the present subject matter may not be construed as limited to doors and may be implemented in vehicle interiors, liftgates or trunks of vehicles as well as in non-vehicle applications.

Figure 2A:
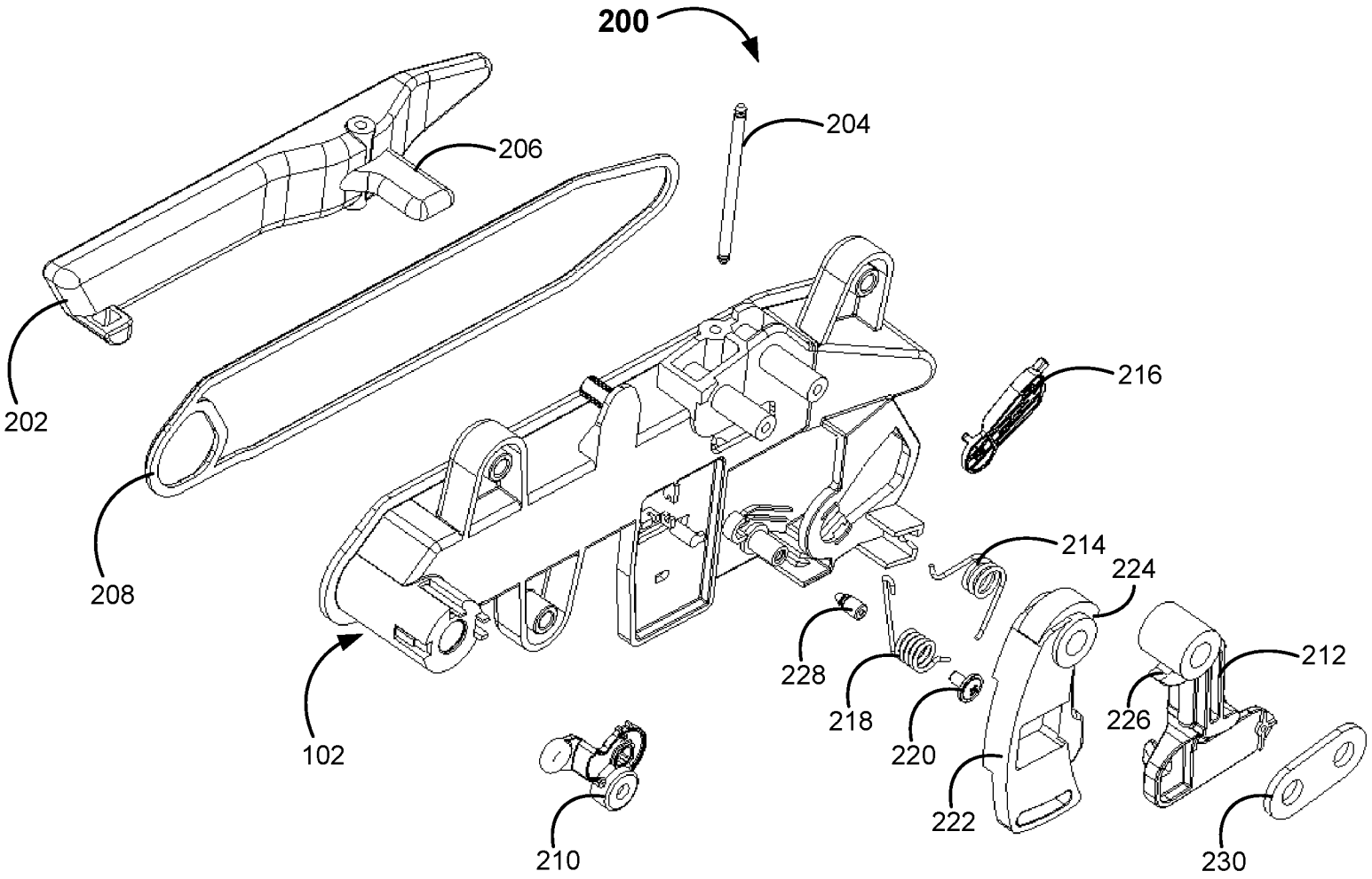
FIGS. 2A & 2B illustrate an exploded and an assembled view of a door handle assembly, according to an example implementation of the present subject matter.
Figure 2B:
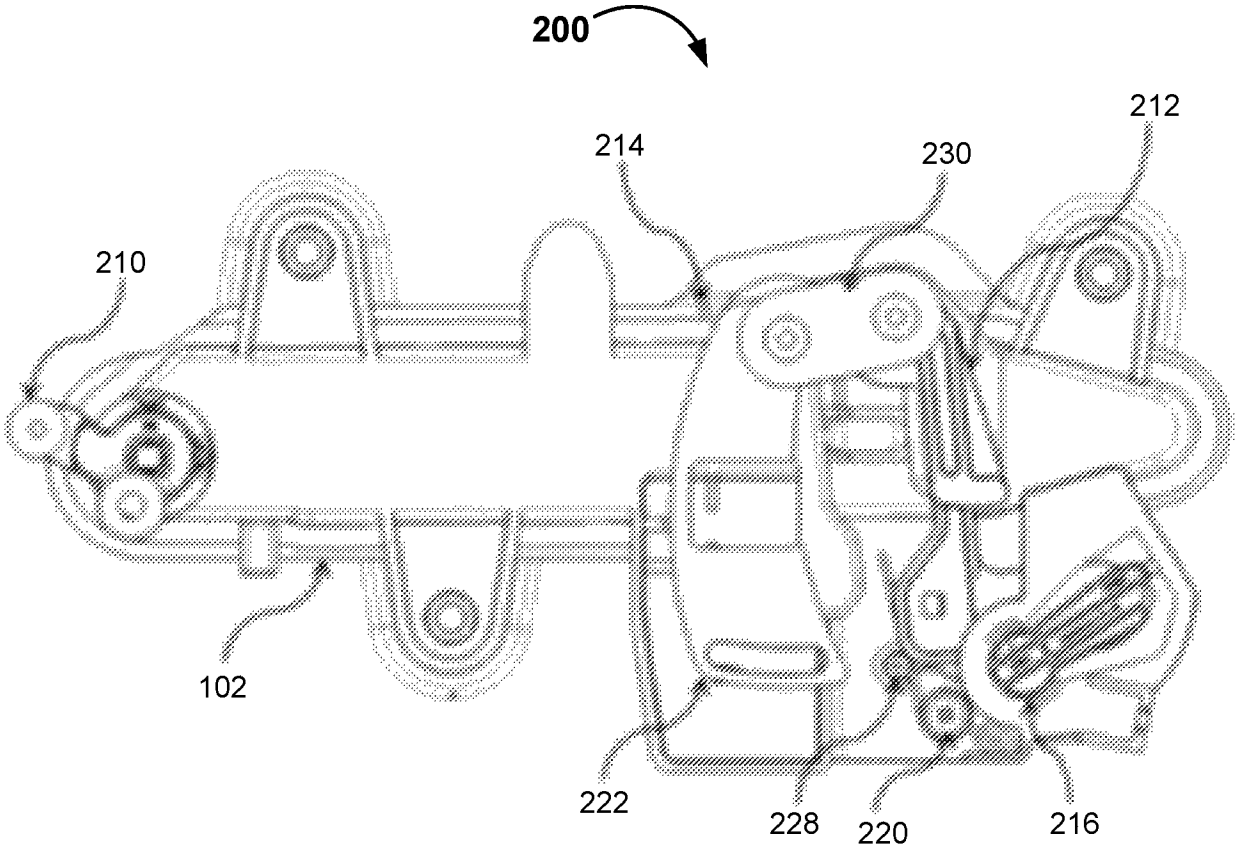

FIGS. 2A & 2B illustrate an exploded and an assembled view of a door handle assembly 200, according to an example implementation of the present subject matter. Referring to FIG. 2A, the door handle assembly 200 may include the frame 102 to be mounted to a door, such as a vehicle door. The frame 102 may include the housing portion 104 and an exterior surface having a cavity (not shown). The door handle assembly 200 may further include a handle 202 for being disposed in the cavity of the frame 102. The handle 202 may be pivoted to the frame 102 via a pivot pin 204. The pivot pin 204 may secure one end of the handle 202 with the frame 102 such that the handle 202 may pivot around the pivot pin 204.

In an implementation, the handle 202 may move between a retracted position or flush position or the undeployed position to the deployed position and vice versa. For example, to move the handle 202 to the deployed position, the handle 202 may be provided a first actuation. In the deployed position, the handle 202 may be provided a second actuation for moving the handle 202 back to the undeployed position. In the present example, the second actuation is provided in a direction opposite to first actuation. Further, the handle 202 may include an actuator member 206. The door handle assembly 200 may also include a sealing member 208 to seal the handle 202 with the cavity. In an example, the sealing member 208 may be a washer or gasket to ensure that the handle 202 is tightly fitted in the cavity of the frame 102. The door handle assembly 200 may also include a latch mechanism 210 operably coupled to the handle 202. For example, when the second actuation is provided to the handle 202 in the deployed position, the latch mechanism 210 may get un-latched and the vehicle door may open.

In another example implementation, there may be instances where a user of the vehicle may not want to open the vehicle door after providing the first actuation to the handle 202, i.e., after the handle 202 has been brought into the deployed position. In this scenario, the user may provide a third actuation, for example, in the form of a push in the same direction as the first actuation, to the handle 202. The actuation of the handle 202 in the deployed position and in the same direction as the first actuation causes the handle 202 to move back to the undeployed or flush position without unlatching the vehicle door. Therefore, the third actuation may be provided to the handle 202 to bring the handle in the undeployed position, without providing the second actuation. In other words, the third actuation may be provided instead of the second actuation to move the handle 202 back to the undeployed position from the deployed position without opening the vehicle door.

In an implementation, the door handle assembly 200 may include the mechanical deployment unit 106 that may be disposed within the housing portion 104 of the frame 102. The mechanical deployment unit 106 may include a leading actuation component 212 for being operably coupled to the actuator member 206 of the handle 202. In an example, the leading actuation component 212 may be connected to a leading preloaded spring 214. The leading preloaded spring 214 may connect the leading actuation component 212 with the frame 102. Further, the mechanical deployment unit 106 may include a locking member 216 to lock the leading actuation component 212 with respect to the frame 102, when the handle 202 is in the undeployed position. The mechanical deployment unit 106 may also include a locking spring 218 coupled to the locking member 216 and to hold the leading actuation component 212 in a locked position. In an example, the locking spring 218 may be a pop-up spring.

Further, the locking spring 218 may be secured to the frame 102 by a fastener 220, such as a screw. The mechanical deployment unit 106 may also include a trailing actuation component 222, such as a bell crank, for being operably coupled to the actuator member 206 of the handle 202 and to the leading actuation component 212. In an example, the trailing actuation component 222 may include a recessed portion 224 to mate with an extended portion 226 of the leading actuation component 212. The mechanical deployment unit 106 of the door handle assembly 200 may further include a suspension element 228, such as a bump stop. The suspension element 228 may prevent metal on metal contact, such as between the frame 102 and the leading actuation component 212. In an example, the leading actuation component 212 and the trailing actuation component 222 may be secured to the housing portion 104 of the frame 102 by a holder 230.

FIG. 2B depicts the assembled view of the door handle assembly 200 in which the handle 202 is in a rest state. In the assembled form, the leading actuation component 212 and the trailing actuation component 222 may abut the actuator member 206 of the handle 202. Therefore, upon actuation of the handle 202, the actuator member 206 may correspondingly displace the leading actuation component 212 and the trailing actuation component 222 to move the handle 202 between the undeployed position and the deployed position.

Further, in the assembled form, one end of the leading actuation component 212 is coupled to the frame 102 through the leading preloaded spring 214. The holder 230 may connect one end of the trailing actuation component 222 with the frame 102 and the leading actuation component 212. In an example, the recessed portion 226 of the trailing actuation component 222 may rest upon the extended portion 224 of the leading actuation component 212. The leading actuation component 212 and the trailing actuation component 222 are so arranged that a movement of the trailing actuation component 222 may cause the leading actuation component 212 to move in an opposite direction. In addition, the locking member 216 and the locking spring 218 may lock the leading actuation component 212 with respect to the frame 102.

Figure 3A:
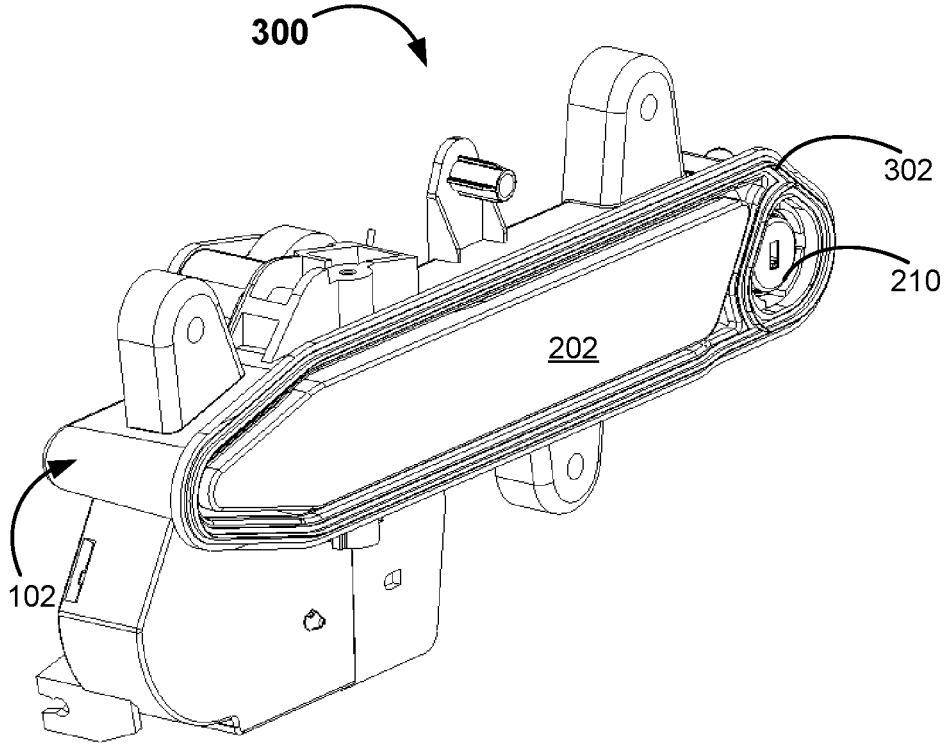
FIGS. 3A & 3B illustrates perspective views of a door handle assembly in an undeployed position of a handle, according to example implementations of the present subject matter.
Figure 3B:
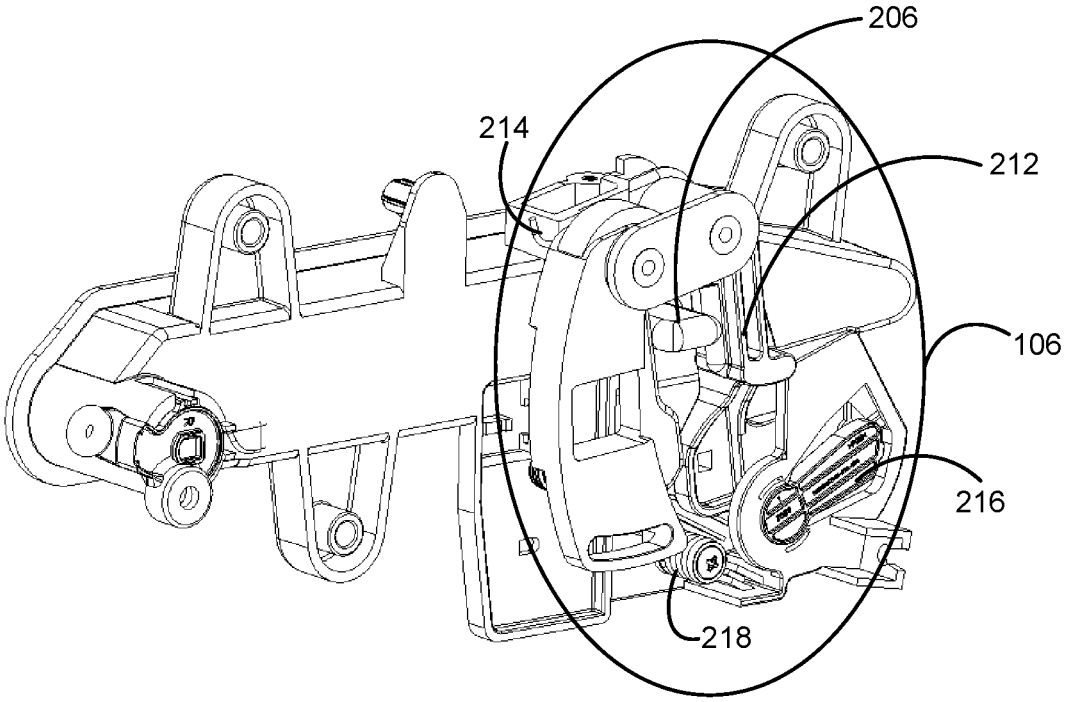

FIGS. 3A & 3B illustrate perspective views of a door handle assembly 300 in an undeployed position of the handle 202, according to example implementations of the present subject matter. The door handle assembly 300 is similar to the door handle assemblies 100 and 200 as explained with reference to FIGS. 1, 2A, and 2B. Referring to FIG. 3A, an initial or rest state of the handle 202 with respect to the frame 102 of the door handle assembly 100 is depicted. In the initial state, the handle 202 is in a flush or the undeployed position with an exterior surface 302 of the frame 102. For example, in the undeployed position, the handle 202 is in-line with the exterior surface 302 of a door in which the door handle assembly 300 may be implemented. As described with reference to FIGS. 1-2B, the handle 202 may be disposed within a cavity of the exterior surface 302. Further, the handle 202 is pivoted to the frame 102. As is also depicted in FIG. 3A, the handle 202 is operably coupled to the latch mechanism 210 of the door handle assembly 300 to unlatch the door.

As mentioned in conjunction with door handle assemblies 100 and 200, the mechanical deployment unit 106 of the door handle assembly 300 is operably coupled to the actuator member 206 of the handle 202. Now referring to FIG. 3B, in the undeployed position of the handle 202, the handle 202 is locked with the mechanical deployment unit 106 of the door handle assembly 300. Further, the locking member 216 and the locking spring 218 of the mechanical deployment unit 106 locks the leading actuation component 212 with respect to the frame 102. In an example, the locking spring 218 may hold the locking member 216 to lock the leading actuation component 212. Further, in the undeployed position of the handle 202, the preloaded spring 214 of the leading actuation component 212 may be preloaded in a direction to move the leading actuation component 212 for bringing the handle 202 in the deployed position.

Figure 4A:
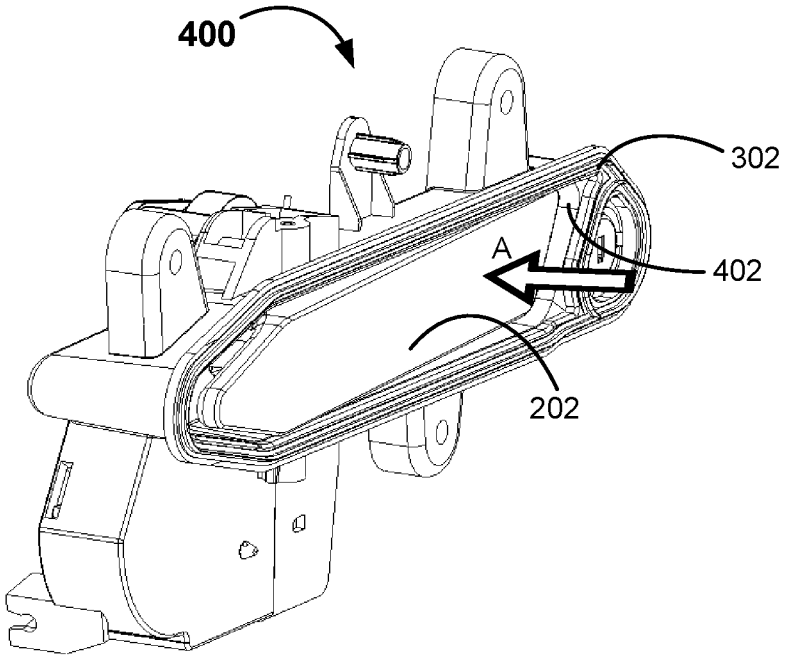
FIGS. 4A & 4B illustrate perspective views of a door handle assembly in a first actuated position of a handle, according to example implementations of the present subject matter.
Figure 4B:
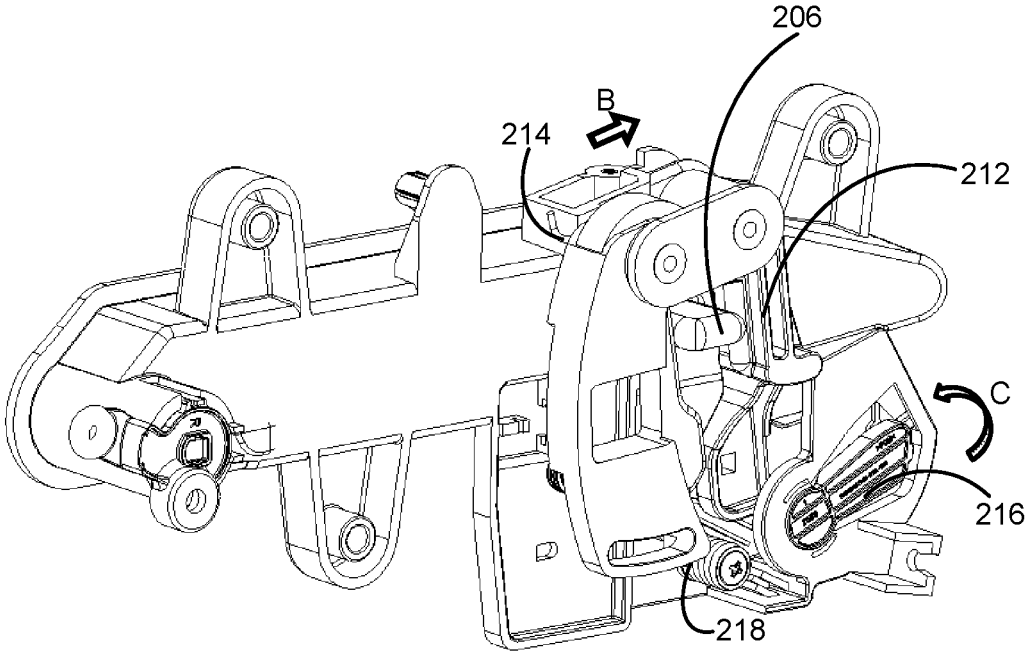

FIGS. 4A & 4B illustrate perspective views of the door handle assembly 400 in a first actuated position of the handle 202, according to example implementations of the present subject matter. To move the handle 202 from the undeployed position to the deployed position, a first actuation is provided to the handle 202. For example, a user may push a portion of the handle 202 with a finger towards a cavity 402 of the exterior surface 302 of the frame 102. The push may act as the first actuation to the handle 202 and the handle 202 may move in a direction as depicted by arrow A. The first actuation may cause the handle 202 to pivot around the pivot pin 204 such that the actuator member 206 of the handle 202 may actuate the leading actuation component 212.

In response to the first actuation to the handle 202, the actuator member 206 of the handle 202 may move in a direction as depicted by arrow B, to push the leading actuation component 212. The movement of the leading actuation component 212 causes the preloaded spring 214 of the leading actuation component 212 to further load. This causes the leading actuation component 212 to rotate in an upward direction as depicted by arrow C. The movement of the leading actuation component 212 in the upward direction, causes the locking member 216 to move along with the leading actuation component 212. The movement of the locking member 216 may result in release of the leading actuation component 212. In addition, the locking spring 218 may get loaded due to the movement of the locking member 216.

Figure 5A:
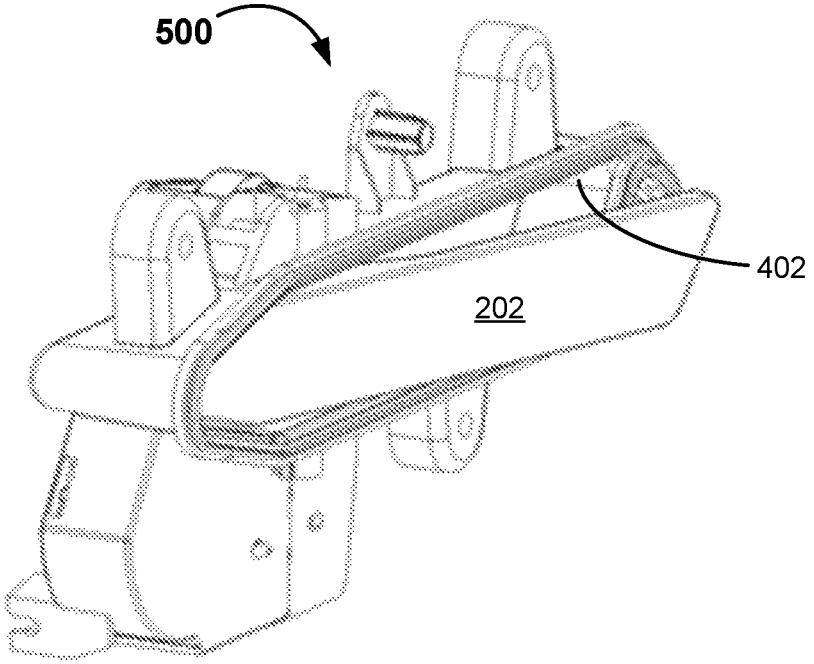
FIGS. 5A & 5B illustrate perspective views of a door handle assembly in a deployed position of a handle, according to example implementations of the present subject matter.
Figure 5B:
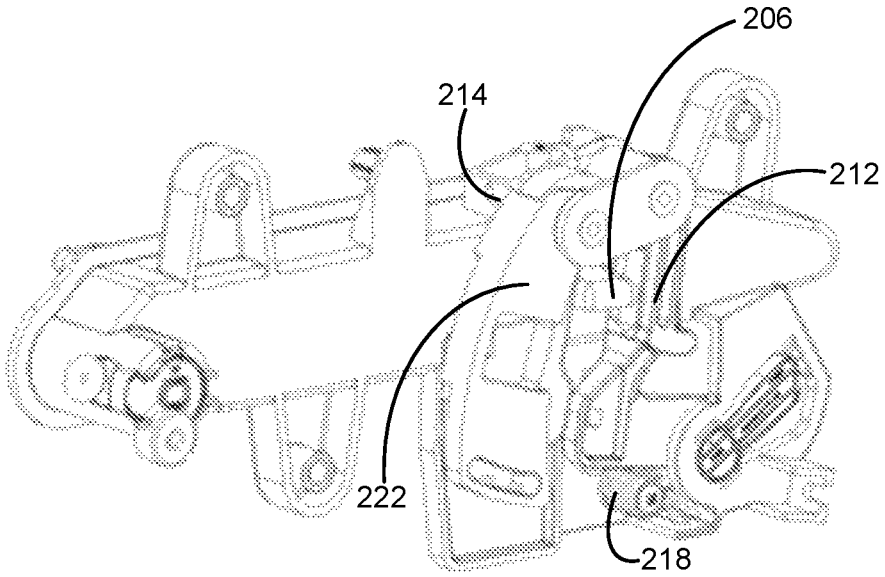

FIGS. 5A & 5B illustrate perspective views of the door handle assembly 500 in a deployed position of the handle 202, according to example implementations of the present subject matter. When the user releases the finger from the handle 202, a first actuation force is removed from the actuator member 206. Now, due to the application of the first actuation force, force may build up in the preloaded spring 214 and the locking spring 218. When the first actuation force is removed, the built-in force is released from the preloaded spring 214 and the locking spring 218. As a result, the leading actuation component 212 is released from the locked state and may freely swing towards the trailing actuation component 222. In an example, swing action of the leading actuation component 212 may displace the actuator member 206 and the trailing actuation component 222, as depicted in FIG. 5B. The displacement or movement of the leading actuation component 212, the actuator member 206, and the trailing actuation component 222, may cause the handle 202 to protrude from the cavity 402. Therefore, the first actuation of the handle 202 may move the handle 202 from the undeployed position to the deployed position, as depicted in FIG. 5A.

Figure 6A:
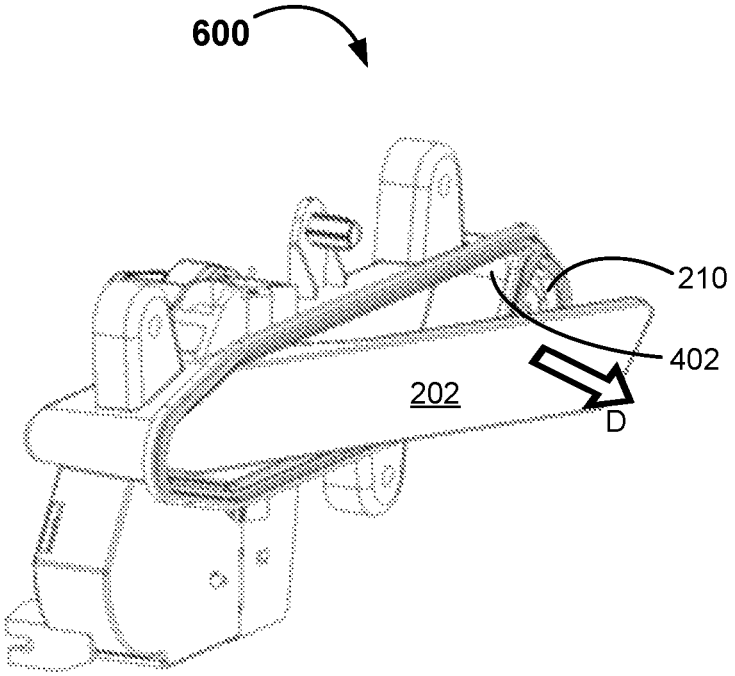
FIGS. 6A & 6B illustrate perspective views of a door handle assembly in a second actuated position of a handle, according to an example implementation of the present subject matter.
Figure 6B:
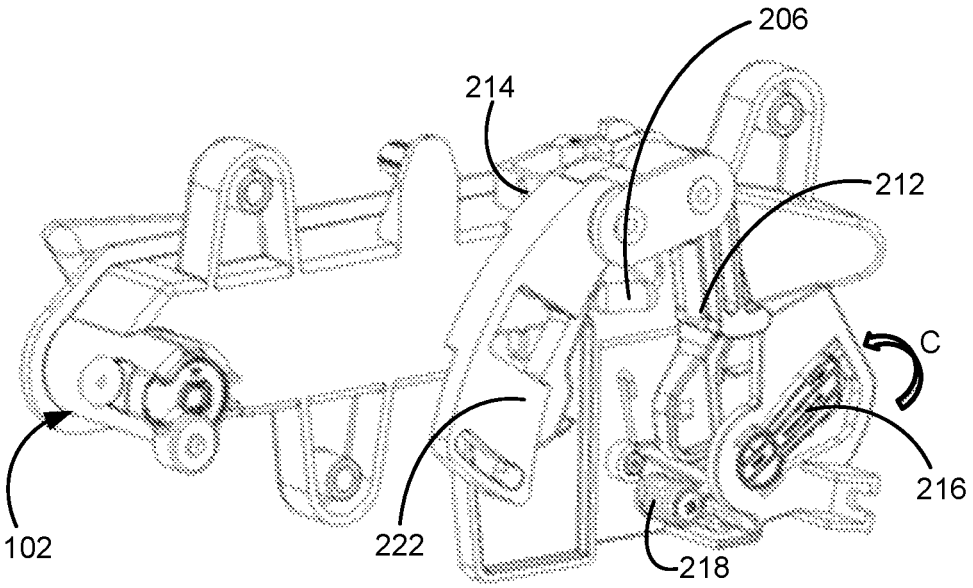

FIGS. 6A & 6B illustrate perspective views of the door handle assembly 600 in a second actuated position of the handle 202, according to example implementations of the present subject matter. In the deployed position, the handle 202 may be used for opening the door, such as the door of a vehicle. As mentioned earlier, the handle 202 may also be coupled to the latch mechanism 210 of the door handle assembly 600. To unlatch and open the door, the user may manually pull the handle 202, from the deployed position, further away from the cavity 402, as depicted by arrow D. The pull may act as the second actuation for the actuator member 206 of the handle 202. In an example, the second actuation is provided in a direction opposite to first actuation.

In an implementation, the second actuation may cause the latch mechanism 210 to un-latch and open the door. Further, in response to the second actuation, the actuator member 206 may move towards the trailing actuation component 222. In an example, the actuator member 206 may push the trailing actuation component 222 away from the leading actuation component 212, as depicted in FIG. 6B. The movement of the trailing actuation component 222 may cause the trailing actuation component 222 to cooperate with the leading actuation component 212 to bring the leading actuation component 212 into the locked state with respect to the frame 102. For example, the recessed position 224 of the trailing actuation component 222 may press against the extended portion 226 of the leading actuation component 212. This in turn may result in the movement of the leading actuation component 212.

The movement of the leading actuation component 212 causes the preloaded spring 214 of the leading actuation component 212 to further load. This causes the leading actuation component 212 to rotate in the upward direction as depicted by arrow C. The movement of the leading actuation component 212 in the upward direction, causes the locking member 216 to come back to its initial position in the frame 102. The movement of the locking member 216 may result in locking of the leading actuation component 212 with respect to the frame 102. In addition, the locking spring 218 may get unloaded when the locking member 216 gets locked with the leading actuation component 212. Therefore, the second actuation of the handle 202 may move the handle 202 from the deployed position to the undeployed position.

In another example implementation, after moving the handle 202 in the deployed position, if the user of the vehicle does not want to open the vehicle door, the user may provide a third actuation to the handle 202 to move the handle 202 back to the undeployed or the flush position. Therefore, the third actuation may be provided to the handle 202 to bring the handle in the undeployed position, without providing the second actuation. The third actuation may be in the form of a push to the handle 202 towards the cavity 402. In an example, the third actuation may be in the same direction as the first actuation. In the example, the latch mechanism 210 may remain undisturbed in response to the third actuation. In other words, the third actuation to the handle 202 does not actuate or move the latch mechanism 210.

In response to the third actuation, the actuator member 206 may move towards the trailing actuation component 222. In an example, the actuator member 206 may push the trailing actuation component 222 away from the leading actuation component 212. The movement of the trailing actuation component 222 may cause the trailing actuation component 222 to cooperate with the leading actuation component 212 to bring the leading actuation component 212 into the locked state with respect to the frame 102. As a result, the handle 202 may be moved back to the undeployed position from the deployed position without opening the vehicle door.

Although the present subject matter has been described with reference to specific embodiments, this description is not meant to be construed in a limiting sense. Various modifications of the disclosed embodiments, as well as alternate embodiments of the subject matter, will become apparent upon reference to the description of the subject matter.

We claim:

1. A door handle assembly, comprising:

a frame to be mounted to a door, the frame including a housing portion and an exterior surface having a cavity;

a mechanical deployment unit disposed in the housing portion, the mechanical deployment unit including a leading actuation component, a trailing actuation component, and a biasing mechanism; and a handle disposed in the cavity and operably coupled to the mechanical deployment unit, the handle being pivotable within the frame such that the handle is moveable between an undeployed position, in which the handle is flush with the exterior surface, and a deployed position, in which the handle protrudes from the cavity, wherein, when the handle is in the undeployed position, the leading actuation component and the trailing actuation component abut opposite sides of an actuator member of the handle, wherein a first actuation on the handle moves the handle toward the frame, the leading actuation component and the biasing mechanism move the handle from the undeployed position to the deployed position after release of the first actuation, and the handle moves from the deployed position to the undeployed position by the trailing actuation component and the biasing mechanism after release of the handle from the deployed position, wherein the mechanical deployment unit is configured to hold the handle in the undeployed position before the first actuation and after a second actuation, and wherein only the actuator member of the handle extends into the housing portion of the frame when the handle is in the undeployed position and the deployed position.

2. The door handle assembly as claimed in claim 1, wherein the mechanical deployment unit further includes:

a locking member coupled to the frame, wherein the locking member is configured to lock movement of the leading actuation component relative to the frame when the handle is in the undeployed position to hold the handle in the undeployed position and, to release movement of the leading actuation component relative to the frame such that the leading actuation component moves with the handle from the undeployed position to the deployed position, and wherein the trailing actuation component moves with the handle from the deployed position to the undeployed position and causes the locking member to re-lock movement of the leading actuation component relative to the frame.

3. The door handle assembly as claimed in claim 2, wherein the biasing mechanism is a preloaded spring that is preloaded in a direction to move the leading actuation component with the handle from the undeployed position to the deployed position.

4. The door handle assembly as claimed in claim 3, wherein, upon the first actuation, the preloaded spring is further loaded to move the handle from the undeployed position to the deployed position after release of the first actuation.

5. The door handle assembly as claimed in claim 2, wherein the locking member is configured to release movement of the leading actuation component relative to the frame upon the first actuation and to re-lock movement of the leading actuation component relative to the frame upon the second actuation.

6. The door handle assembly as claimed in claim 5, wherein the mechanical deployment unit further includes:

a locking spring coupled to the locking member, wherein the locking spring is configured to actuate the locking member to release the leading actuation component upon the first actuation and to hold the locking member to lock movement of the leading actuation component upon the second actuation.

7. The door handle assembly as claimed in claim 1, further comprising:

a latch mechanism operably coupled to the handle, wherein, when the second actuation is provided to the handle, the handle un-latches the latch mechanism to unlatch the door.

8. The door handle assembly as claimed in claim 7, wherein, after the first actuation and before the second actuation, a third actuation on the handle causes the actuator member of the handle to move the trailing actuation component in a direction away from the leading actuation component such that the handle moves from the deployed position to the undeployed position by movement of the leading actuation component and the trailing actuation component without un-latching the latch mechanism.

9. The door handle assembly as claimed in claim 8, wherein the third actuation is provided in a direction that is the same as that of the first actuation.

10. The door handle assembly as claimed in claim 1, wherein the second actuation is provided in a direction that is opposite that of the first actuation.

11. A door handle assembly comprising:

a frame to be mounted to a door, the frame including a housing portion and an exterior surface having a cavity;

a handle disposed in the cavity and having an actuation member, the handle being pivoted to the frame such that the handle is moveable between an undeployed position, in which the handle is flush with the exterior surface, and a deployed position, in which the handle protrudes from the cavity; and a mechanical deployment unit disposed in the housing portion of the frame and operably coupled to the actuator member of the handle, the mechanical deployment unit including:

a leading actuation component operably coupled to the actuator member of the handle;

a trailing actuation component operably coupled to the actuator member of the handle and to the leading actuation component; and a locking member coupled to the frame, wherein, when the handle is in the undeployed position, the leading actuation component and the trailing actuation component abut opposing sides of the actuator member of the handle, wherein the locking member is configured to lock movement of the leading actuation component relative to the frame when the handle is in the undeployed position to hold the handle in the undeployed position and to release movement of the leading actuation component relative to the frame such that the leading actuation component moves with the handle from the undeployed position to the deployed position, and wherein the trailing actuation component moves with the handle from the deployed position to the undeployed position and causes the locking member to re-lock movement of the leading actuation component relative to the frame.

12. The door handle assembly as claimed in claim 11, wherein the leading actuation component includes a preloaded spring that is preloaded in a direction to move the leading actuation component with the handle from the undeployed position to the deployed position.

13. The door handle assembly as claimed in claim 12, wherein, upon a first actuation, the preloaded spring is further loaded to move the handle from the undeployed position to the deployed position once a first actuation force is removed.

14. The door handle assembly as claimed in claim 12, further comprising:

a latch mechanism operably coupled to the handle, wherein upon a second actuation, the handle un-latches the latch mechanism and the trailing actuation component moves with the handle from the deployed position to the undeployed position.

15. The door handle assembly as claimed in claim 14, wherein, after a first actuation and upon a third actuation, the trailing actuation component cooperates with the leading actuation component to bring the leading actuation component into a locked state with respect to the frame and the handle moves from the deployed position to the undeployed position.

16. The door handle assembly as claimed in claim 15, wherein the third actuation is provided in a direction that is the same as that of the first actuation.

17. The door handle assembly as claimed in claim 11, wherein the locking member is configured to release movement of the leading actuation component relative to the frame upon a first actuation and to re-lock movement of the leading actuation component relative to the frame upon a second actuation.

18. The door handle assembly as claimed in claim 17, wherein the mechanical deployment unit further includes a locking spring coupled to the locking member, wherein the locking spring actuates the locking member to release the leading actuation component upon the first actuation, and to hold the locking member to lock the leading actuation component upon the second actuation.

* * * * *